US006354124B1

(12) United States Patent
Bürgel et al.

(10) Patent No.: US 6,354,124 B1
(45) Date of Patent: Mar. 12, 2002

(54) METHOD AND APPARATUS FOR THE HYDRAULIC FORMING OF WORKPIECES

(75) Inventors: Lonka Bürgel, Pöhla; Frank Schieck, Lauter, both of (DE)

(73) Assignee: KUKA Werkzeugbau Schwarzenberg GmbH, Schwarzenberg (DE)

( * ) Notice: Subject to any disclaimer, the term of this patent is extended or adjusted under 35 U.S.C. 154(b) by 0 days.

(21) Appl. No.: 09/453,409

(22) Filed: Dec. 3, 1999

(30) Foreign Application Priority Data

Dec. 3, 1998 (DE) ..... 198 55 753

(51) Int. Cl.[7] ..... B21D 26/02

(52) U.S. Cl. ..... 72/60; 72/57; 72/370.22; 29/421.1

(58) Field of Search ..... 72/56, 57, 60, 72/379.6, 370.22; 29/421.1

(56) References Cited

U.S. PATENT DOCUMENTS

| | | | | |
|---|---|---|---|---|
| 2,728,317 A | | 12/1955 | Clevenger et al. | |
| 5,277,045 A | * | 1/1994 | Mahoney et al. | 72/60 |
| 6,052,887 A | * | 4/2000 | Dziadosz | 72/57 |

FOREIGN PATENT DOCUMENTS

| | | | | |
|---|---|---|---|---|
| DE | 1279616 | * | 10/1968 | 72/60 |
| DE | 44 17 460 | | 11/1995 | |
| DE | 197 32 413 | | 2/1999 | |
| JP | 59232629 | | 12/1984 | |
| JP | 3-230822 | * | 10/1991 | 72/60 |
| JP | 5-15931 | * | 1/1993 | 72/60 |
| JP | 5-50153 | * | 3/1993 | 72/60 |

* cited by examiner

*Primary Examiner*—David Jones
(74) *Attorney, Agent, or Firm*—Lacasse & Associates

(57) ABSTRACT

Internal high pressure forming at present takes place by exerting a pressure between sheet metal blanks fixed by a marginal weld. It has already been proposed to deform under high internal pressure sheet metal blanks merely placed on one another in a combined clamping and sealing die. Problems arise with regards to the sealing and material flow. Thus, to overcome the aforementioned disadvantages, the invention proposes a method for forming at least one workpiece under high liquid or hydraulic pressure, in which the workpiece, during pressure build-up, is initially marginally clamped in per se known manner and in the final phase of forming to the desired final shape of the workpiece (sizing) the marginal area of the workpiece is freed. It also proposes an apparatus (1) for the hydraulic forming of at least one workpiece by means of a forming die (21) having an upper and a lower part (26, 24), which clamp the workpiece in marginal areas whilst allowing an also differing material flow, the forming die (21) being surrounded by a pressure casing (2) separate therefrom.

21 Claims, 5 Drawing Sheets

METHOD AND APPARATUS FOR THE HYDRAULIC FORMING OF WORKPIECES

FIELD OF THE INVENTION

The invention relates to a method for forming or shaping at least one work piece using high liquid pressure and an apparatus for forming at least one workpiece using high liquid pressure by means of a forming die having an upper part and a lower part, which fix the workpiece in marginal areas, but whilst permitting a material flow.

BACKGROUND OF THE INVENTION

Hydraulic or high pressure forming was developed with respect to closed workpieces such as pipes. It has also already been proposed to double sheet metal blanks by a circumferential, tight weld and to hydraulically form same by pressurizing in the gap. If the sheet metal blanks are not to be jointly used, it is necessary for them to be subsequently separated again in a complicated manner. A further disadvantage results from the fact that there is a restricted material flow behaviour due to the weld and associated therewith almost the same material, flow for the upper and lower workpiece, which once again significantly limits the choice of part pairings for parts having different geometries or also the possible complexity of the parts. It has therefore been proposed to shape doubled sheer metal blanks without a fixed (welded) connection, the tightness or seal in the marginal area not being brought about by welding, but by subjecting the marginal areas of the two sheet metal blanks to a combined clamping and forming die action, cf. DE 195 35 170 Al. This causes the problem that with a fixed clamping adequate for achieving the necessary tightness, it is not possible to ensure an adequate plastic flow, which is to be made possible by the lack of a welded connection. Although such a plastic flow is permitted by reducing the clamping force, this decreases the tightness between the marginal areas of the sheet metal parts.

Thus, whilst avoiding the aforementioned disadvantages, the problem of the invention is to provide an apparatus for forming workpieces, such as in particular sheet metal blanks, by means of which an optimum forming of optionally also one workpiece is possible.

SUMMARY OF THE INVENTION

According to the invention, the set problem is solved with a method of the aforementioned type, which is characterized in that during the pressure build-up, the workpiece is marginally clamped in per se known manner and that in the final phase of forming to the desired final shape of the workpiece (sizing) the marginal area of the workpiece is freed or released.

For solving the set problem an apparatus according to the invention is characterized by a pressure casing surrounding and separated from the forming die.

As a result of the solution according to the invention on pressurizing on one side of a workpiece (or between two workpieces) the necessary plastic flow of the workpieces is ensured, whilst during the final forming or shaping (sizing), the workpieces are marginally exposed and no longer have to be fixed, so that the complete workpiece shape can undergo the sizing process. As intentionally a maximum, high pressure-tight seal in the clamping area of the dies is renounced, the tightness is brought about by a pressure-tight encapsulation of the die, particularly by a pressure casing separate from and completely surrounding the forming die.

In a preferred development, the closing force of the die is adjustable. The forming die closing force can be adjusted in such a way that it is just below the opening force of the sizing pressure necessary for the final forming or sizing of the particular workpieces. So that a controlled release of the clamping action is possible, according to further developments of the invention drive mechanisms for moving die parts on the one hand and casing parts on the other are separate mechanisms and that there is a limited vertical clearance with the die closed, including spacing rings and plates, as well as workpieces within the pressure casing and that the drive mechanism (press mechanism) for the casing has a higher closing force than the drive mechanism for the die, so that the workpieces are clamped in the marginal area by the die with a closing force which is below the closing force with which the casing parts are kept closed.

According to a further development of the inventive method, both workpieces are initially marginally clamped, whilst interposing a spacing element.

According to a particularly preferred development of the inventive apparatus one part (lower part) of the pressure casing has on the inside a circumferential recess and that another part (upper part) of the pressure casing has a projection of limited thickness engaging in the recess, which creates a high pressure seal. Under a high liquid pressure acting thereon within the pressure casing, the projection is pressed radially outwards against the wall or shoulder of the recess on the other part of the pressure casing, so that the tightness is increased with an increasing internal pressure.

In addition, a low pressure seal can be provided. This is brought about by a seal between facing faces of the pressure casing parts. In a specific development, in facing faces of the pressure casing parts are formed grooves in which the seal engages. The low pressure seal can be constructed in different ways either by being constituted by solid, elastic material or a hose fillable with a pressure medium or fluid.

According to another preferred development of the invention, , between the upper and lower parts of the forming die is placed a spacing ring, so that a workpiece can be clamped between part of the die and the spacing ring and optionally a further workpiece is clampable between the spacing ring and the other part of the die. Such a spacing ring leads to the workpieces being desirably mechanically deformable in their die-clamped marginal areas and, if simultaneously two workpieces are shaped, do not have to be shaped in their marginal areas in the same or a complimentary manner. Thus, in a preferred development the top and bottom of the spacing ring is at least in part non-parallel and/or non-planar. Moreover, through a planned introduction of drawing creases or shut-off edges between the spacing ring and die parts the material flow can be controlled differently between the upper and lower workpieces.

According to a further development the spacing ring has a filling inlet. Thus, between directly engaging sheet metal blanks there is no need to provide an inlet for the hydraulic fluid and in said inlet area the sheet metal blanks are shaped in a manner not corresponding to their final shape but due to the necessity of the inlet. In the case of an inlet directly between the edges of sheet metal blanks, as is the case in the prior art, sealing or tightness problems arise. These disadvantages are avoided by the inlet guided substantially radially or laterally through the spacing ring. The inlet can either be directly connected to the inner area of the pressure casing surrounding the forming die or the filling inlet of the spacing ring can be aligned with a filling passage of the pressure casing when the latter and the die are closed. A bushing forms a tight connection between the spacing ring inlet and the pressure casing passage. The bushing producing the connection between the pressure casing passage and the spacing ring inlet is preferably firmly connected to the spacing ring or constructed in one piece thereon and engages with its end facing the casing passage and which is preferably constructed as a circumferential collar in an annular groove of the casing, which can be formed by two semicircular grooves in the upper and lower part at the interfaces of said two parts.

According to another preferred development of the invention there is a closable emptying outlet (through the pressure casing wall). Accompanied by the interposing of spacing plates the die can be located in the pressure casing.

BRIEF DESCRIPTION OF THE DRAWINGS

Further advantages and features of the invention can be gathered from the claims and the following description of an embodiment of the invention with reference to the attached drawings, wherein show:

DETAILED DESCRIPTION OF THE DRAWINGS

Figure 1:
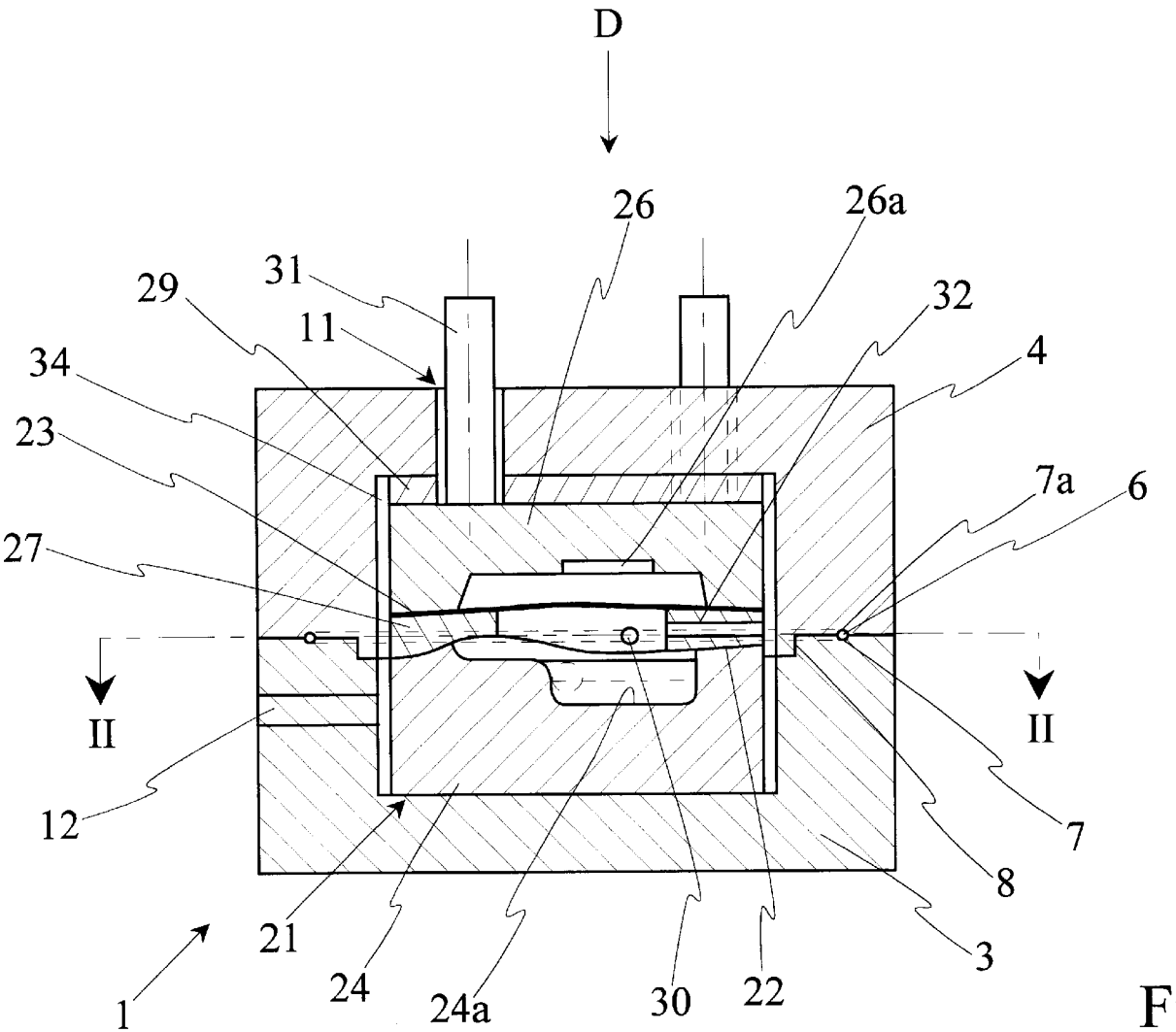
FIG. 1 A vertical section through the inventive apparatus with inserted sheet metal blanks.

The inventive apparatus 1 for the hydraulic forming of sheet metal blanks by means of high pressure has a pressure casing 2 comprising a lower part 3 and an upper part 4. Between the lower and upper parts 3 and 4 is provided a low pressure seal 6 formed from a circumferentially closed sealing ring or hose, which is inserted in two appropriately constructed grooves 7, 7*a* of the die lower and upper parts 3, 4. When the low pressure seal 6 is constructed as a sealing hose, it can be exposed to a pressure fluid in the interior.

In the represented embodiment the lower part 3 has at the inner circumference in the vicinity of the face facing the upper part 4 a circumferential shoulder 8 with which corresponds a downwardly projecting projection 9 on the underside of the upper part 4 in the vicinity of its inner wall and which relative to the total thickness of the parts 3 and 4 has only a very limited thickness d. The gap on the outside of the projection 8 between the latter and the casing lower part 3 in FIG. 4 only has to have a tolerance width, so that on vertically bringing together the two casing parts the projection 9 is not damaged. Through the shoulder and projection 9 is formed a high pressure seal, because when high pressure is applied to the wall area 9*a* of the projection 9 directed towards the interior of the casing 2 it is sealingly pressed against the vertical wall of the lower part 3 bounding the inner shoulder 8.

Figure 2:
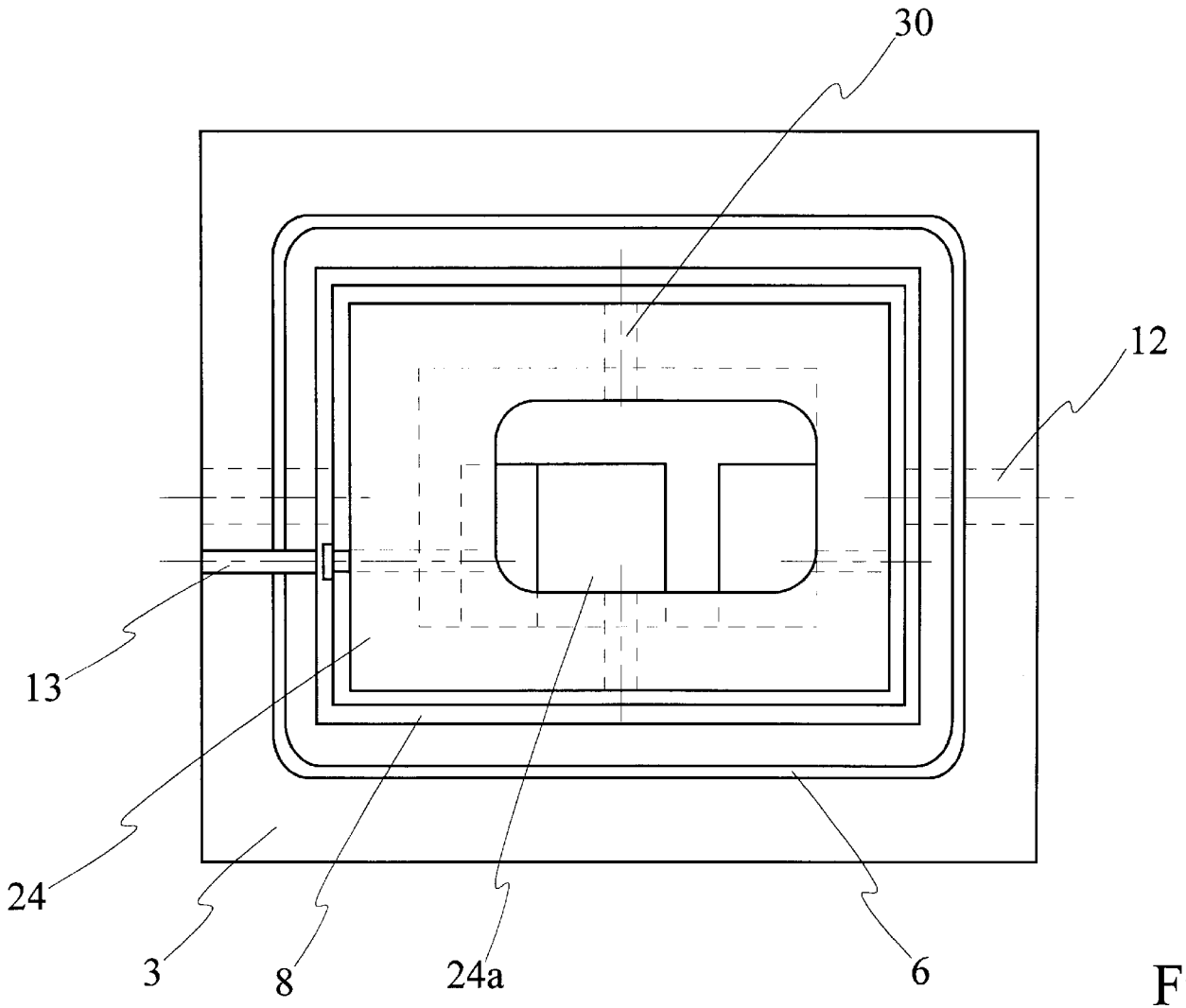
FIG. 2 A plan view corresponding to II—II in FIG. 1 of the lower parts of the inventive apparatus FIG. 3 The inventive apparatus in the opened state with inner structures shown in broken line form.

The casing upper part 4 has passages 11 for pressure bolts (FIG. 1) or rapid filling inlets for the pressure casing. It also has a hydraulic fluid inlet 13 (FIGS. 2 and 5) and one or more pressure relief outlets 12 (FIG. 1). The former are constituted by two corresponding, semicircular grooves in the moved together faces of the casing lower and upper parts 3, 4, and when the casing is closed forms a tubular passage.

Thus, the interior of the pressure casing 2 can be reliably sealed even against very high pressures. In the interior thereof is located the actual forming die 21 for forming the sheet metal blanks 22, 23 and in FIG. 1 the increased thickness of the blank 23 compared with the blank 22 and the shoulders in the marginal areas thereof, it is indicated that the sheet metal blank 23 is a multilayer or sandwich blank and the individual layers can at least partly be welded.

The die 21 comprises a lower part 24 with a die structure 24*a* and an upper part 26 with a die structure 26*a*, the die structures in each case determining the shape of the sheet metal blanks formed by high pressure forming using the apparatus according to the invention. In the represented construction of the inventive apparatus for forming two sheet metal blanks, there is a spacing ring, 27 between them.

The faces of the die parts 24, 26 engaging on the edges of the sheet metal blanks 22, 23, as well as the spacing ring 27 can fundamentally be planar and can optionally extend perpendicular to the closing forces acting thereon (arrow D). It can be seen in the embodiment shown that the faces in question need not be oriented perpendicular to the acting mechanical forces represented by arrow D and can instead have an inclination with respect thereto and also need not be plannar, but can instead be curved, so as to permit a random forming in the marginal areas between the die parts 23, 24 and in the represented embodiment in the spacing ring 27.

On the top of the die part 26 between the latter and the horizontal inner wall of the casing upper part can be located spacing elements such as the spacing element 29 in the form of flat metal parallelepipeds. Fundamentally there can also be spacing elements on the bottom of the casing lower part 3 between the latter and the die part 24.

By means of pressure bolts 31 projecting through openings 11 in the casing upper part 4, the die upper part 26 is connected to a first, no shown press mechanism. The die upper part 4 is connected to a second, not shown press mechanism, which can apply a higher compressive force than the press acting on the die 21.

Figure 5:
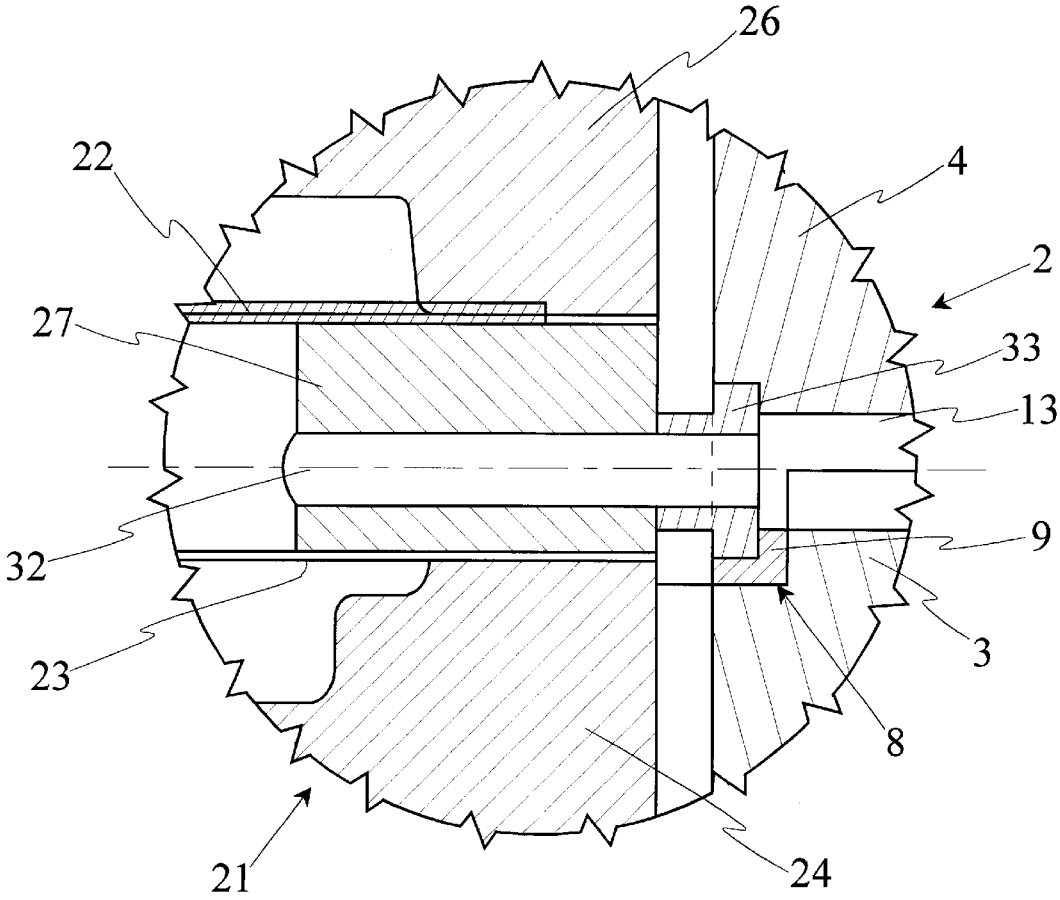
FIG. 5 A detail of the inlet for the hydraulic fluid in the forming die of the inventive apparatus.
Figure 6:
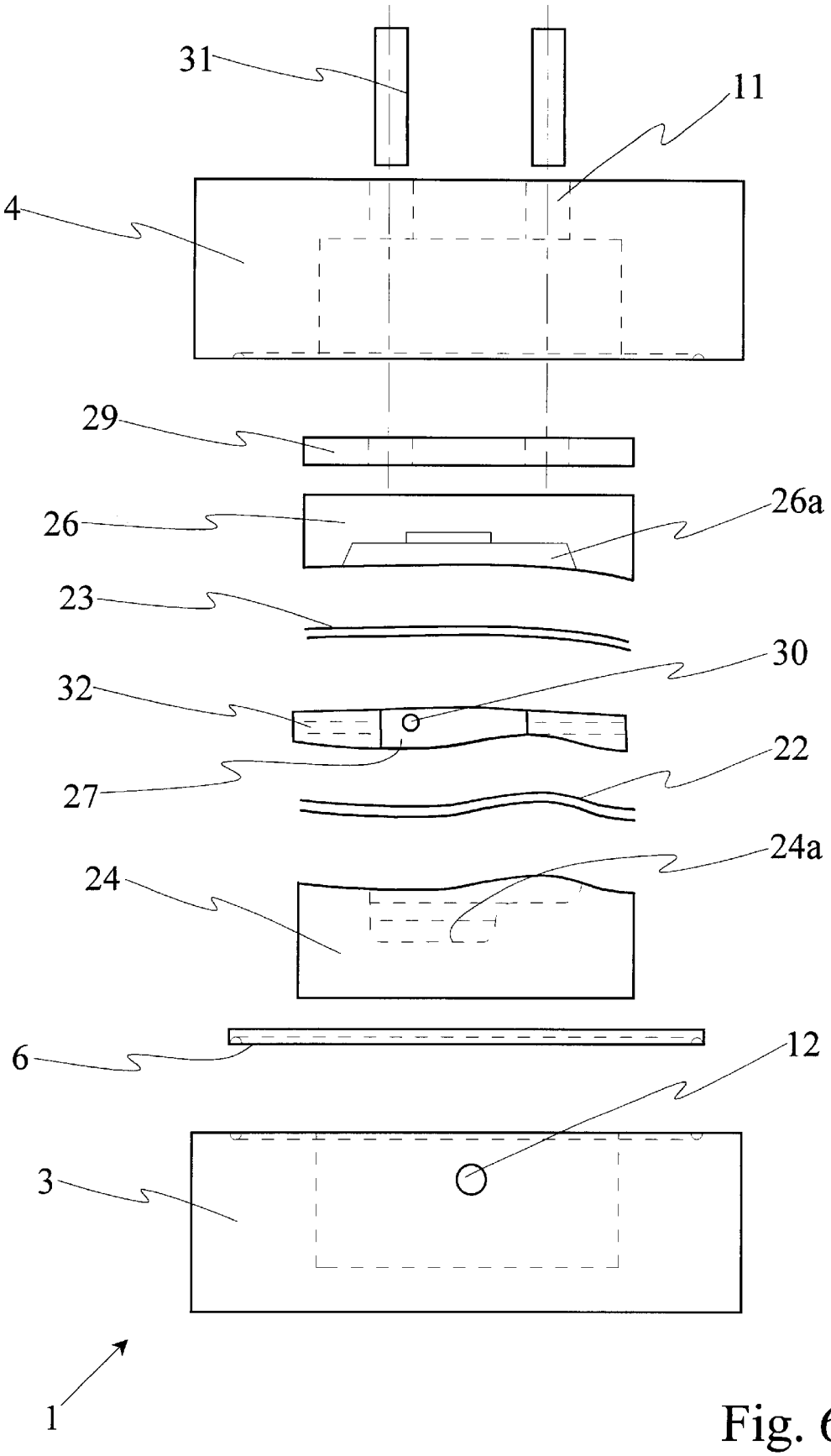
FIG. 6 An exploded view of the essential parts of the inventive apparatus.

For introducing the hydraulic fluid into the interior of the die 21 between the two sheet metal blanks 22, 23 to be formed the spacing ring 27 with a filling passage or port 32 is constructed as a filling ring (FIG. 5). The inlet 32 in the spacing ring 27 is aligned with the passage 3 in the casing 2 and is connected to the latter by means of a bushing 33, so that the cavity between the blanks 24, 26 is directly connected to the not shown, hydraulic pressure filling device and not via the lateral gap 34 between the die 21 and casing 2- in order to permit a plastic flow of the sheet metal blanks 22, 23 in the marginal clamping area- it does not have to be so firmly and strongly fixed according to the invention that there is a pressure-tight closure of the die interior with respect to its exterior 34, so that in the represented embodiment there can be a controlled pressure difference between the high pressure interior, limited by the sheet metal blanks to be deformed and the spacing ring, as well as the gap 34, which can e.g. be controlled by means of a valve via the pressure outlet 12.

In an alternative design the passage 13 and inlet 32 merely issue into the gap 34. In such a case the apparatus has no outlet 12 or such an outlet is closed during the functioning of the apparatus. Then, essentially the same pressure conditions prevail in the gap and in the interior between the sheet metal blanks to be deformed.

Figure 3:
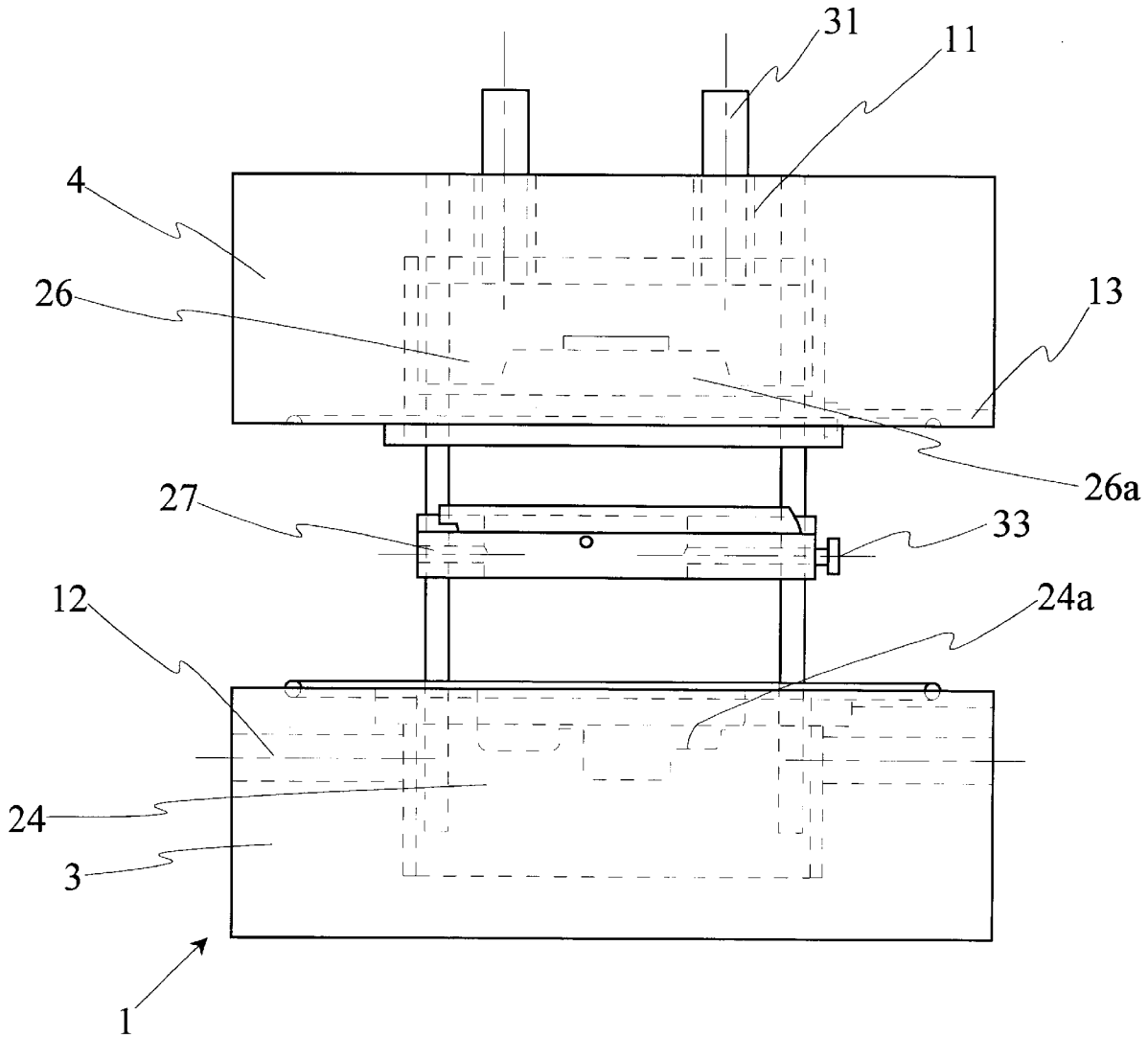
Figure 4:
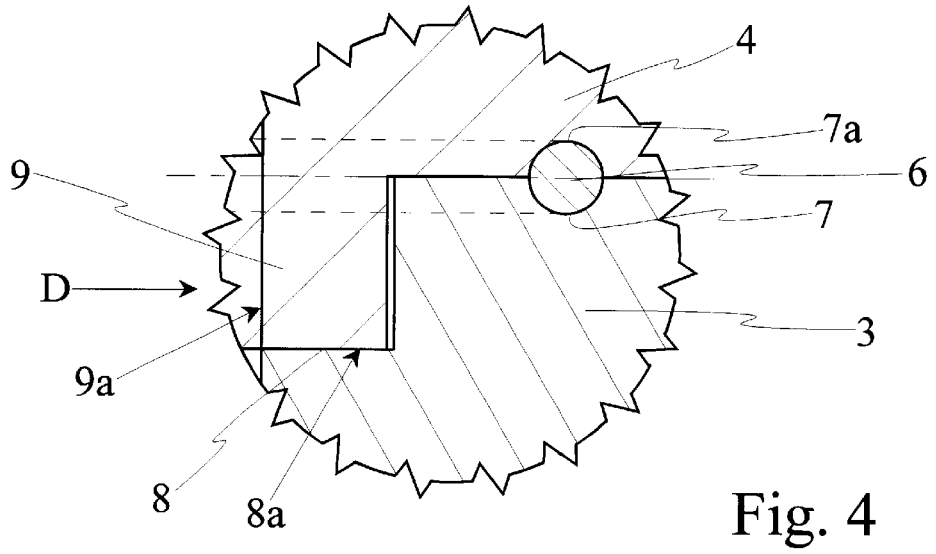
FIG. 4 A detail of the high pressure seal of the inventive apparatus.

According to the invention, the forming of the sheet metal blanks takes place as follows:

Initially the casing 2 of the inventive apparatus 1 is in an opened state, as can be gathered from FIGS. 3 and 4. Initially the lower sheet metal blank 22 is inserted. The spacing ring 27 which is vertically spaced from the die lower part 24 is moved against the die 24. Optionally the upper sheet metal blank 23 is then inserted. The die 21 is then closed, by the upper part 26 moving downwards. In the represented embodiment with non-planar faces of dies and spacing ring not perpendicular to the closing direction, there is then a mechanical, free forming of the sheet metal blanks corresponding to the contours of the die parts and the spacing ring.

The casing 2 is closed when the die 21 is closed or immediately thereafter.

This is followed by the filling of the die 21 or more precisely the gap between the sheet metal blanks 22, 23 and the spacing ring 27 with the working medium (hydraulic fluid). Pressure is also applied to the hose-like low pressure seal, so that it fulfils its function.

The holding-down force acts on the drawing flanges of the sheet metal blanks 22, 23 independently of the closing force of the casing 2 and is lower than the latter.

This is followed by the pressure build-up in the forming area of the sheet metal blanks 22, 23 after overcoming the yield point, so that the forming process commences and for as long as the blanks 22, 23 have no contact with the drawing dies 24*a*, 26*a*, there is a uniform stress distribution within the metal sheet. The material flow can optionally be separately adjustable between both sheet metal blanks, in that it can on the one hand be controlled by holding-down forces and on the other by drawing creases and/or shut-off edges and optionally also in a local manner and which can be constructed as a function of the geometry of the sheet metal part.

By means of differential pressure valves 30 in the spacing ring 27 there is a controlled filling of the gap 34 and, initially with the pressure build-up in the interior of the die, it is also possible in the initial stage to have a separate filling of the gap 34. Since, as stated, the holding-down force of the die 21 is always lower than the sealing force of the casing 2, to a limited extent the working medium can also pass via the contact faces of the sheet metal blanks 22, 23 into the gap 34 which, through the lubricating effect of the hydraulic fluid, aids the after-flow of the material of the sheet metal blanks.

As a result of the pressure build-up in the gap 34, the high pressure seal formed by the shoulder 28 and projection 29 becomes increasingly effective, because the elastic projection 9 is more strongly pressed against the sealing surface 8*a*, so that the sealing effect increases with the internal pressure applied, so that the low pressure seal 6 is relieved.

At the end of the pressure build-up, the holding-down force of the die 21 is no longer brought about by member 31 due to the press mechanism acting thereon. With increased pressure build-up and when the sheet metal blanks engage on the die structures 24, 26 as a result of the high internal pressure the latter are pressed against the casing parts 3, 4, so that the end or sizing pressure corresponds to the maximum holding closed force of the apparatus, which is transferred from the casing 1 to the die 21 via the spacing plate 29 in the embodiment shown. The die parts 24, 26, are raised from one another to a minimum extent, so that they no longer secure in their marginal areas the sheet metal blanks 22, 23. At this time the after-flow process is ended. In a further serial model modification of the apparatus through a corresponding dimensioning of the casing, spacing plates and die parts or by a vertical length compensation the lifting of the die parts is reduced if this is needed by the forming process.

Following sizing, a pressure decrease takes place, optionally by opening the valves, so that the seals are relieved. The casing 2 is then opened and the hydraulic fluid is emptied from the gap 34. Simultaneously or subsequently the die 21 is opened, which also brings about an emptying of the forming area. The two sheet metal parts can be removed, accompanied by a displacement or pivoting of the spacing ring. The inventive apparatus is then ready for a further filling for further forming processes.

What is claimed is:

1. An apparatus for forming at least one workpiece using high liquid pressure comprising:

a forming die with an upper part and a lower part for clamping a marginal area about a periphery of the workpiece whilst allowing a material flow therein; and, a pressure casino having, an inside wall surrounding and separated from the forming die, comprising:

a first part having an end with an inner circumferential shoulder; and, a second part having an end with a projection projecting therefrom for mating with the end of the first part such that the projection engages the inner circumferential shoulder, wherein a thickness of the projection is less than a broadness of the shoulder, and wherein an applied pressure to the inside wall forces the projection to be sealingly engaged against the circumferential shoulder to form a high pressure seal.

2. An apparatus according to claim 1 comprising a low-pressure seal between the mating ends of the pressure casing.

3. An apparatus according to claim 2 wherein each end of the first and second parts includes a semi-circular groove for engaging the low-pressure seal.

4. An apparatus according to claim 2 wherein the low-pressure seal is made form a solid, elastic material.

5. An apparatus according to claim 2 wherein the low-pressure seal is a hose seal fillable with a pressure medium.

6. An apparatus for high pressure forming, particularly according to one of the preceding claims comprising:

a spacing ring disposed between the upper and lower parts of the forming die for cooperatively clamping the at least one workpiece between a top surface of the spacing ring and an opposing surface of the upper part of the forming die, and for optionally clamping a second other workpiece between a bottom surface of the spacing ring and an opposing surface of the lower part of the forming die.

7. An apparatus according to claim 6 wherein the spacing ring has a filling inlet.

8. An apparatus according to claim 7 wherein, in use, the filling inlet of the spacing ring is aligned with a filling passage of the pressure casing.

9. An apparatus according to claim 8 comprising a bushing for providing a tight connection between the inlet of the spacing ring and the passage of the pressure casing.

10. An apparatus according to claim 6 wherein at least a portion of the top and bottom surfaces of the spacing ring are other than parallel to one.

11. An apparatus according to claim 9 comprising a closable emptying outlet extending through the wall of the pressure casing and which can functionally also be used as an additional filling device for the pressure casing.

12. An apparatus according to claim 10 wherein the die is placed in the pressure casing, accompanied by the interposing of spacing plates.

13. An apparatus according to claim 11 wherein the drive mechanism for moving the die parts and the drive mechanism for moving the pressure casing parts are separate mechanisms.

14. An apparatus according to claim 12 wherein by means of the drive mechanisms for the die upper part and drawing creases on the spacing ring a different material flow between the upper and lower workpieces is achieved on a side.

15. An apparatus according to claim 13 wherein the drive mechanism for the pressure casing has a higher closing force than the drive mechanism for the die.

16. An apparatus according to claim 14 wherein the closing force of the drive mechanism for the die is adjustable.

17. An apparatus according to claim 15 wherein there is a limited vertical clearance when the die is closed, including optionally spacing rings and plates, and workpieces within the pressure casing.

18. An apparatus according to claim 7 wherein at least a portion of the top and bottom surfaces of the spacing ring are other than parallel to one another.

19. An apparatus according to claim 18 wherein the die is placed in the pressure casing, accompanied by the interposing of spacing plates.

20. An apparatus according to claim 19 wherein by means of the drive mechanisms for the die upper part and drawing creases on the spacing ring a different material flow between the upper and lower workpieces is achieved on a side.

21. An apparatus according to claim 20 wherein the closing force of the drive mechanism for the die is adjustable.

* * * * *